US007548227B2

(12) United States Patent
Lee

(10) Patent No.: US 7,548,227 B2
(45) Date of Patent: Jun. 16, 2009

(54) DISPLAY APPARATUS, DEVICE FOR DRIVING THE DISPLAY APPARATUS, AND METHOD OF DRIVING THE DISPLAY APPARATUS

(75) Inventor: Sung-Ho Lee, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 633 days.

(21) Appl. No.: 10/922,595

(22) Filed: Aug. 20, 2004

(65) Prior Publication Data

US 2005/0052401 A1 Mar. 10, 2005

(30) Foreign Application Priority Data

Sep. 8, 2003 (KR) ..... 10-2003-0062615

(51) Int. Cl.
*G09G 3/36* (2006.01)

(52) U.S. Cl. ..... 345/99; 345/98; 345/100; 345/213

(58) Field of Classification Search ..... 345/98–100, 345/204, 209, 30, 1.1, 213, 156
See application file for complete search history.

(56) References Cited

U.S. PATENT DOCUMENTS

| | | | | |
|---|---|---|---|---|
| 6,122,185 | A * | 9/2000 | Utsunomiya et al. | 363/60 |
| 6,411,162 | B2 * | 6/2002 | Minamizaki et al. | 330/255 |
| 6,542,150 | B1 * | 4/2003 | Kotha et al. | 345/213 |
| 2002/0060673 | A1 * | 5/2002 | Noritake et al. | 345/204 |
| 2002/0089485 | A1 * | 7/2002 | Youn | 345/99 |
| 2002/0093475 | A1 * | 7/2002 | Hashimoto | 345/87 |
| 2002/0167502 | A1 * | 11/2002 | Yamazaki et al. | 345/204 |
| 2003/0034947 | A1 | 2/2003 | Tanaka et al. | |
| 2003/0132903 | A1 * | 7/2003 | Ueda | 345/87 |
| 2003/0184511 | A1 * | 10/2003 | Sekido et al. | 345/99 |
| 2004/0070589 | A1 * | 4/2004 | Morita et al. | 345/690 |

FOREIGN PATENT DOCUMENTS

| | | |
|---|---|---|
| CN | 1291762 | 4/2001 |
| EP | 0899712 | 3/1999 |

OTHER PUBLICATIONS

Chinese Office Action for application No. 200410076867.1, dated Sep. 28, 2007, and an English translation thereof, citing the above cited references.

* cited by examiner

*Primary Examiner*—Amr Awad
*Assistant Examiner*—Jeff Pelligrino
(74) *Attorney, Agent, or Firm*—Cantor Colburn LLP

(57) ABSTRACT

A device for driving a display apparatus includes a scan driver, a timing circuit and a data driver. The scan driver generates a plurality of scan signals activating the scan lines. The timing circuit generates a control signal. The data driver samples a first gray scale voltage signal in response to the control signal, and generates a second gray scale voltage signal to provide a display panel of the display apparatus with the second gray scale voltage signal. The second gray scale voltage signal has a sampled voltage level of the first gray scale voltage signal, and the sampled voltage level is synchronized with the control signal. The deterioration of the display quality due to ripples may be reduced.

11 Claims, 6 Drawing Sheets

DISPLAY APPARATUS, DEVICE FOR DRIVING THE DISPLAY APPARATUS, AND METHOD OF DRIVING THE DISPLAY APPARATUS

CROSS-REFERENCE TO RELATED APPLICATIONS

This application relies for priority upon Korean Patent Application No. 2003-62615 filed on Sep. 8, 2003, the contents of which are herein incorporated by reference in its entirety.

BACKGROUND OF THE INVENTION

1. Field of the Invention

The present invention relates to a display apparatus, a device for driving the display apparatus, and a method of driving the display apparatus.

2. Description of the Related Art

Liquid crystal display (LCD) devices having small/medium display screen used for, for example, mobile phone uses charge pump because small power consumption and small size of driver integrated circuit (IC) are required.

FIG. 1A is a circuit diagram showing a general charge pump circuit, and FIGS. 1B and 1C are graphs showing on-off operations of the switches SWC1, SWC2, SWC3 and SWC4.

As shown in FIGS. 1A, 1B and 1C, when the first and second switches SWC1 and SWC2 for charging purpose are turned-on and the switches SWG1 and SWG2 for regulating purpose are turned-off, the first capacitor C1 is charged with the charges of the battery. Afterwards, when the first and second switches SWC1 and SWC2 are turned-off and the switches SWG1 and SWG2 are turned-on, the charges accumulated at the first capacitor C1 and the charges of the battery are charged at the second capacitor C2. The second capacitor C2 regulates (or smoothes) an output voltage signal VCP of the charge pump.

However, the output voltage signal VCP of the charge pump has ripples due to variation of an output load since the charge pump does not perform regulating operation according to the variation of the output load.

Liquid crystal display devices employ a capacitor and generate gray scale voltage signals (or data voltage signals), and the liquid crystal display devices employs a capacitor having a large capacitance so as to reduce the ripples. However, the capacitor having the large capacitance may induce increased size of the charge pump circuit of the liquid crystal display devices.

Further, even though the capacitor having the large capacitance is employed in the charge pump of the liquid crystal display device, the ripples may not completely be prevented. Thus, ripple (or water-fall) phenomenon is shown on the display screen of the liquid crystal display device. Especially, the ripple (or water-fall) phenomenon is serious in the liquid crystal display devices having small/medium display screen that is driven using line inversion method.

FIG. 2B is a graph showing a waveform of a voltage signal VCP output from a charge pump employed in a liquid crystal display device, and FIG. 2A is a graph showing a waveform of a voltage signal VD that is obtained after regulating the voltage signal VD of FIG. 2B.

The voltage signal VCP is a square wave signal generated from the charge pump. When a capacitor is coupled to the charge pump so as to regulate the square wave, a reference gray scale voltage signal VD of FIG. 2A is obtained. The waveform of the reference gray scale voltage signal VD of FIG. 2A has ripples. The capacitor coupled to the charge pump so as to regulate the square wave has a large capacitance.

The gray scale voltage signals (or data voltage signals) corresponding to 'a' point, 'b' point or 'c' point of the reference gray scale voltage signal VD may be applied to data lines of a liquid crystal display panel. Thus, it is not predictable which point ('a', 'b' or 'c', etc.) of the reference gray scale voltage signal VD will be shown as the gray scale voltage signals.

Especially, the ripple phenomenon is serious in middle gray scale levels in which the voltage deviation between gray scale levels is small. For example, when each of Red, Green and Blue data are expressed using 6 bits (total 18 bits for the RGB data), the gray scale levels of each of Red, Green and Blue data is 64 and the total number of color combination is 262,144 ($2^6*2^6*2^6$=262,144 colors, $2^6$=64 gray scale levels).

In a middle gray scale level such as 32-gray scale level, when the gray scale voltage level corresponding to 'a' point of the reference gray scale voltage signal VD is difference from the gray scale voltage level corresponding to 'b' point of the reference gray scale voltage signal VD, the voltage deviation between gray scale levels is generated, and ripples are shown on the display screen.

Namely, even though the gray scale voltage signal has the same gray scale level, a gray scale voltage level corresponding to a point between 'a' and 'b' points of the reference gray scale voltage signal VD may be applied to a portion of the display screen and a gray scale voltage level corresponding to a point between 'b' and 'c' points of the reference gray scale voltage signal VD may be applied to another portion of the display screen, thus ripples are shown on the display screen.

SUMMARY OF THE INVENTION

Accordingly, the present invention is provided to substantially obviate one or more problems due to limitations and disadvantages of the related art.

It is a first feature of the present invention to provide a device for driving a display apparatus, which may reduce the deterioration of the display quality due to ripples.

It is a second feature of the present invention to provide a display apparatus having the device.

It is a third feature of the present invention to provide a method of driving the display apparatus, which may reduce the deterioration of the display quality due to ripples.

In one exemplary embodiment, a device for driving a display apparatus includes a timing circuit and a data driver. The timing circuit is configured to generate a control signal. The data driver is configured to sample a first gray scale voltage signal in response to the control signal, and configured to generate a second gray scale voltage signal to provide a display panel of the display apparatus with the second gray scale voltage signal. The second gray scale voltage signal has a sampled voltage level of the first gray scale voltage signal, and the sampled voltage level is synchronized with the control signal.

In another exemplary embodiment, a device for driving a display apparatus having a display panel includes a scan driver, above mentioned timing circuit and data driver. The display panel has a plurality of scan lines, a plurality of data lines and a plurality of pixels. The scan driver is configured to generate a plurality of scan signals activating the scan lines.

In still another exemplary embodiment, a display apparatus includes a display panel, above mentioned scan driver, timing circuit and data driver. The display panel has a plurality of scan lines, a plurality of data lines and a plurality of pixels.

In still another exemplary embodiment, a method of driving a display apparatus includes: generating a control signal; and generating a second gray scale voltage signal by sampling a first gray scale voltage signal in response to the control signal to provide the display apparatus with the second gray scale voltage signal. The second gray scale voltage signal has a sampled voltage level of the first gray scale voltage signal, and the sampled voltage level is synchronized with the control signal.

BRIEF DESCRIPTION OF THE DRAWINGS

The above and other features and advantages of the present invention will become more apparent by describing in detail exemplary embodiments thereof with reference to the accompanying drawings, in which.

DESCRIPTION OF EMBODIMENTS

Figure 1A:
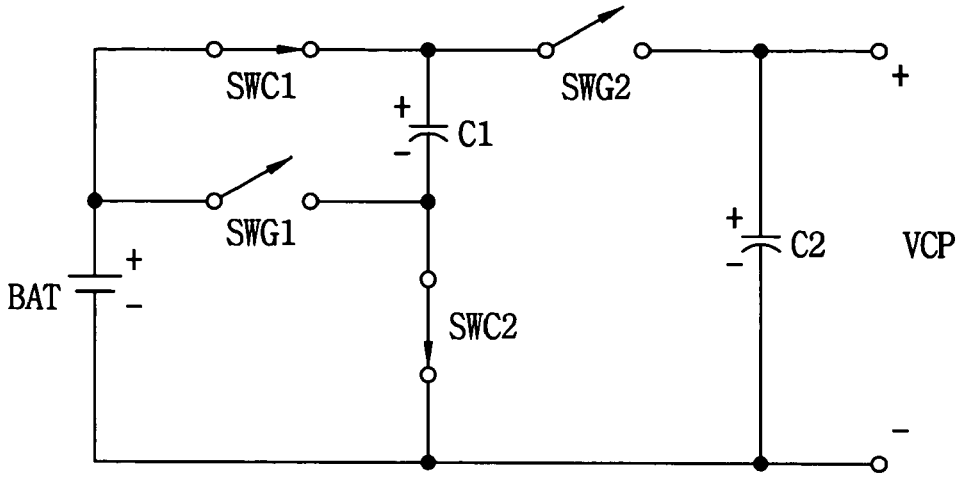
FIG. 1A is a circuit diagram showing a general charge pump circuit.

Detailed illustrative embodiments of the present invention are disclosed herein. However, specific structural and functional details disclosed herein are merely representative for purposes of describing exemplary embodiments of the present invention. This invention may, however, be embodied in many alternate forms and should not be construed as limited to the embodiments set forth herein.

Accordingly, while the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention.

Figure 3:
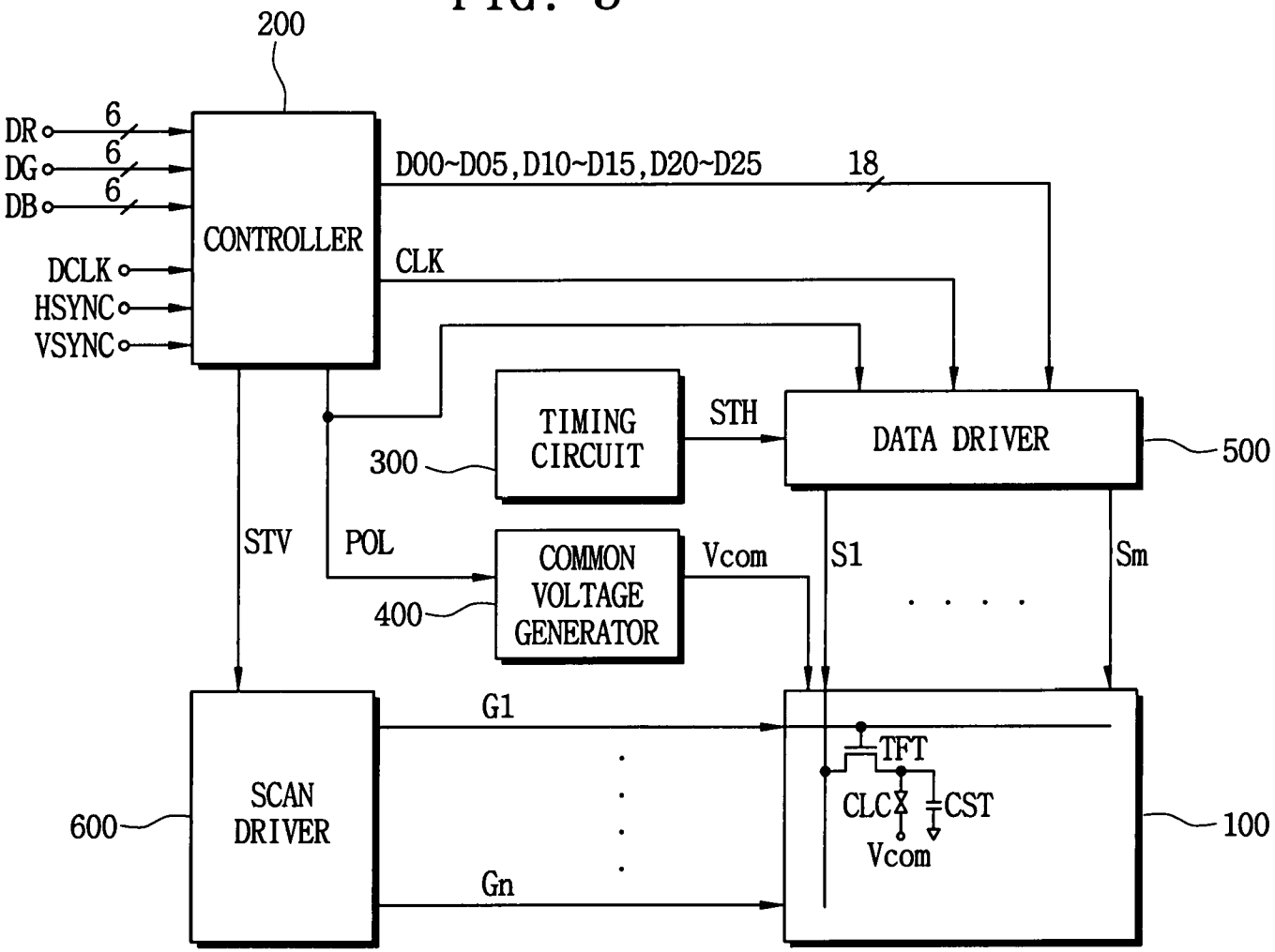
FIG. 3 is a block diagram showing a liquid crystal display device according to one exemplary embodiment of the present invention.

FIG. 3 is a block diagram showing a liquid crystal display device according to one exemplary embodiment of the present invention.

Referring to FIG. 3, the liquid crystal display device includes a liquid crystal display panel 100, a controller 200, a timing circuit 300, a common voltage generator 400, a data driver 500 and a scan driver 600. The controller 200, the timing circuit 300, the common voltage generator 400, the data driver 500, and the scan driver 600 drive the liquid crystal display panel 100.

The liquid crystal display panel 100 includes a plurality of pixels. A plurality of scan lines is arranged in a row direction, and a plurality of data lines is arranged in a column direction.

Each of the pixels includes a switching element, a liquid crystal capacitor CLC and a storage capacitor CST. The switching element is coupled to a scan line and a data line. For example, the switching element includes a thin film transistor (TFT). The liquid crystal capacitor CLC is connected between a drain electrode of the TFT and a common electrode. The storage capacitor CST charges the liquid crystal capacitor CLC during a vertical synchronization period.

R (red), G (Green) and B (Blue) data (DR, DG and DB) are supplied from an external graphic controller, and the controller 200 generates image data, for example D00~D05, D10~D15 and D20-D25, based on the RGB data (DR, DG and DB), respectively, and provides the image data D00~D05, D10~D15 and D20-D25 to the data driver 500. Gray scale voltage signals are generated based on the image data D00~D05, D10~D15 and D20-D25 by the data driver 500, and are provided to the source electrode of the TFT via the data lines. The scan signals are generated in response to a horizontal synchronization signal (HSYNC) and a vertical synchronization signal (VSYNC), and are applied to the gate electrode of the TFT while common voltage Vcom is applied to the common electrode of the liquid crystal capacitor CLC. For example, the R (red), G (Green) and B (Blue) data (DR, DG and DB) are expressed using 6 bits, respectively, and the image data D00~D05, D10~D15 and D20-D25 are expressed using 18 bits.

The controller 200 generates a clock signal CLK, a polarization signal POL and a vertical start pulse STV based on a dot clock signal DCLK, the horizontal synchronization signal (HSYNC) and the vertical synchronization signal (VSYNC), and provides the clock signal CLK to the data driver 500, the polarization signal POL to the data driver 500 and the common voltage generator 400, and the vertical start pulse STV to the scan driver 600. The clock signal CLK may have the same frequency as the dot clock signal DCLK or different frequency from the dot clock signal DCLK. The polarization signal POL is inverted every horizontal synchronization period (or every line) and is used for AC (alternate current) driving of the liquid crystal display panel 100. For example, the vertical start pulse STV has the same period as the vertical synchronization signal (VSYNC).

The timing circuit 300 generates a control signal STH and provides the data driver 500 with the control signal STH.

The common voltage generator 400 receives the polarization signal POL and generates a common voltage Vcom to provide the common voltage Vcom to the common electrode of the liquid crystal display panel 100. For example, the common voltage Vcom has a ground potential or a power voltage level VDD.

For example, the common voltage generator 400 provides the common voltage Vcom having the ground potential to the common electrode when the polarization signal POL has a high level, and provides the common voltage Vcom having the power voltage level VDD to the common electrode when the polarization signal POL has a low level The data driver 500 selects one of the gray scale voltage signals using the clock signal CLK, the image data D00~D05, D10~D15 and D20-D25 and the control signal STH, and outputs the selected gray scale voltage signals to the data lines of the liquid crystal display panel 100.

For example, the data driver 500 includes a resistor array (not shown) having cascade-connected resistors. The resistor array functions as a voltage divider that divides the reference gray scale voltage signals into a plurality of gray scale voltage signals.

The scan driver 600 generates a plurality of scan signals for activating the scan lines in response to the vertical start pulse STV, and provides the scan lines of the liquid crystal display panel 100 with the scan signals sequentially.

Figure 4:
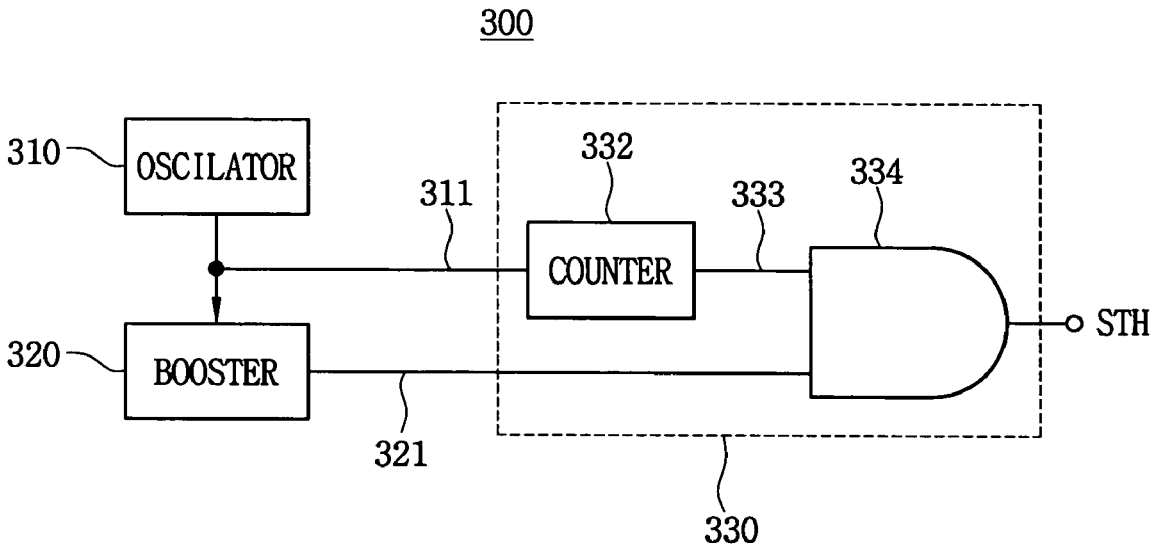
FIG. 4 is a circuit diagram showing a timing circuit of FIG. 3 according to one exemplary embodiment of the present invention.
Figure 5A:
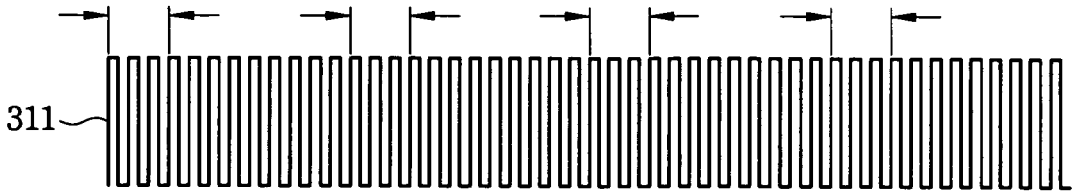
FIGS. 5A, 5B, 5C and 5D are graphs showing the waveforms of the signals for describing the operation of the timing circuit of FIG. 4.
Figure 5B:
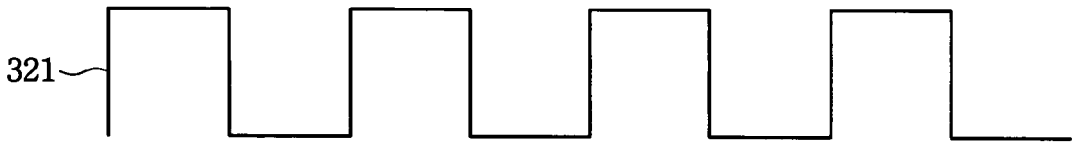
Figure 5C:
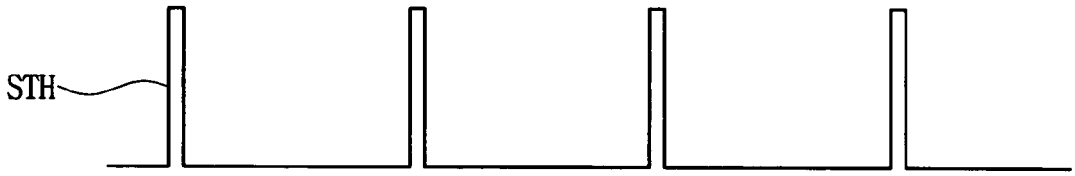
Figure 5D:
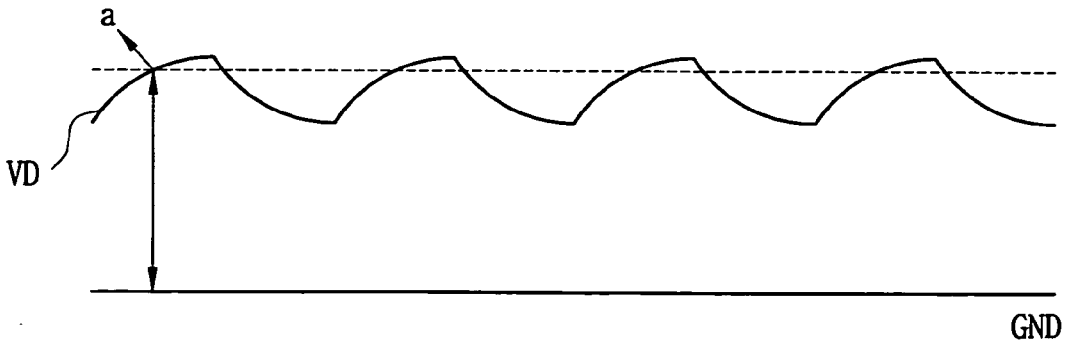

FIG. 4 is a circuit diagram showing a timing circuit of FIG. 3 according to one exemplary embodiment of the present invention, and FIGS. 5A, 5B, 5C and 5D are graphs showing the waveforms of the signals for describing the operation of the timing circuit of FIG. 4.

Referring to FIG. 4, the timing circuit 300 includes an oscillator 310, a booster 320 and an operation circuit 330.

The oscillator 310 generates a first oscillating signal 311 and provides the booster 320 and the operation circuit 330 with the first oscillating signal 311.

Figure 1B:
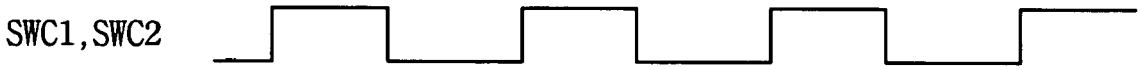
FIGS. 1B and 1C are graphs showing on-off operations of the switches SWC1, SWC2, SWC3 and SWC4.
Figure 1C:
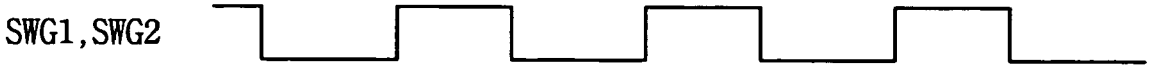
Figure 2A:
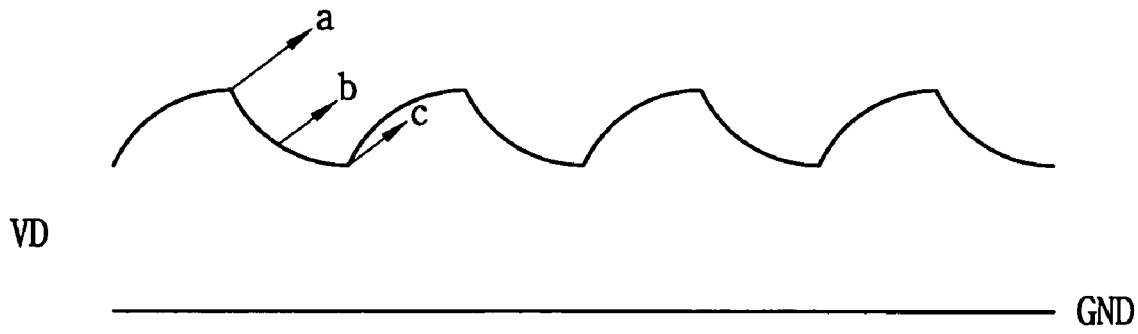
FIG. 2A is a graph showing a waveform of a voltage signal VD that is obtained after regulating the voltage signal VD of FIG. 2B.
Figure 2B:
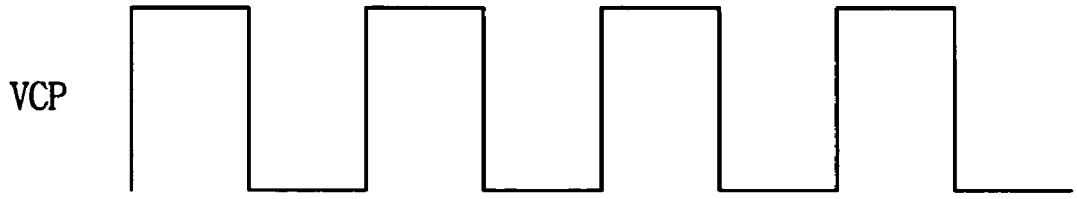
FIG. 2B is a graph showing a waveform of a voltage signal VCP output from a charge pump employed in a liquid crystal display device.

The booster 320 boosts the first oscillating signal 311 to generate a second oscillating signal 321, and provides the operation circuit 330 with the second oscillating signal 321. For example, the liquid crystal display devices applied to mobile phone having small/medium display screen includes a charge pump since the power consumption is small and small driver IC is used therein. An example of the charge pump is shown in FIGS. 1A, 1B and 1C.

The operation circuit 330 includes a counter 332 and an AND gate 334. The operation circuit 330 generates the control signal STH based on the first and second oscillating signals 311 and 321, and provides the control signal STH to the data driver 500.

For example, the counter 332 receives the first oscillating signal 311, counts the number of pulses of the first oscillating signal 311 of FIG. 5, generates a square wave signal 333 when the number of the pulses satisfies a given condition, and provides the square wave signal 333 to the AND gate 334. The square wave signal 333 may be activated in response to every given number of the pulses of the first oscillating signal 311. For example, the counter 332 outputs the square wave signal 333 every four pulses of the first oscillating signal 311 after the second oscillating signal 321 is activated.

The AND gate 334 performs a logical AND operation on the second oscillating signal 321 and the square wave signal 333 to generate the control signal.STH when the AND gate 334 receives the second oscillating signal 321 having an active level and the square wave signal 333 having an active level.

The data driver 500 outputs the gray scale voltage signal corresponding to a given point, for example 'a' point, of the reference gray scale voltage signal in response to the control signal STH. Since the gray scale voltage signals are applied to the data lines in a predetermined timing, the ripples are not generated, and the deterioration of the display quality may be prevented.

In addition, the size of the liquid crystal display device using the charge pump circuit may be reduced because the capacitor coupled to the output terminal of the charge pump circuit has a low capacitance and the capacitor having a high capacitance may not be required at the output terminal of the charge pump so as to reduce the ripples, and thus the manufacturing cost may be reduced.

Figure 6:
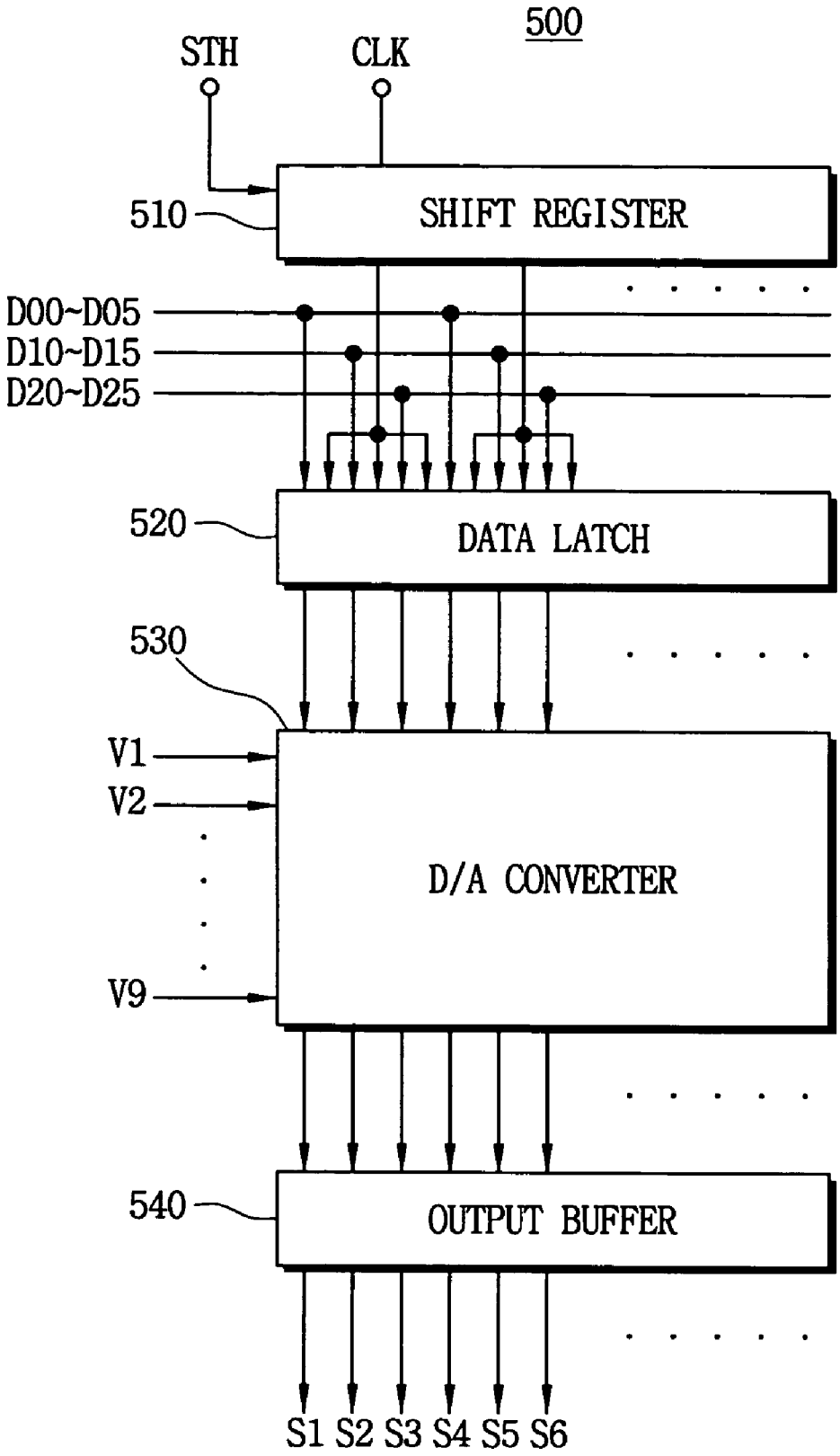
FIG. 6 is a block diagram showing a data driver of FIG. 3 according to one exemplary embodiment of the present invention.

FIG. 6 is a block diagram showing a data driver of FIG. 3 according to one exemplary embodiment of the present invention.

Referring to FIGS. 3 through 6, the data driver 500 includes a shift register 510, a data latch 520, a digital-to-analog converter (DAC) 530 and an output buffer 540. The data driver 500 outputs the gray scale voltage signals (or data voltage signals) to the data lines of the liquid crystal display panel 100 in response to the control signal STH supplied from the timing circuit 300.

The shift register 510 receives the clock signal CLK and the control signal STH, and outputs the clock signal CLK in response to an active period of the control signal STH to provide the shifted clock signals CLK to the data latch 520.

The data latch 520 receives the shifted clock signals CLK and the image data, for example D00~D05, D10~D15 and D20-D25, and latches the value of the image data D00~D05, D10~D15 and D20-D25 at an instance when the clock signal CLK synchronized with the active period of the control signal STH is input to the data latch 520. For example, the data latch 520 includes a plurality of latch circuits, and each of the latch circuits receives the clock signal CLK and one of the image data D00~D05, D10~D15 and D20-D25. The latch circuit turned on by the clock signal CLK latches one of the image data D00~D05, D10~D15 and D20-D25.

Namely, the data latch 520 temporarily stores the image data D00~D05, D10~D15 and D20-D25. The data latch 520 outputs the stored image data D00~D05, D10~D15 and D20-D25 to the DAC 530 in response to the shifted clock signal CLK.

The DAC 530 receives a plurality of reference gray scale voltage signals to provide the output buffer 540 with analog gray scale voltage signals corresponding to the values of the image data D00~D05, D10~D15 and D20-D25 supplied from the data latch 520. For example, the DAC 530 receives nine reference gray scale voltage signals (V1, V2, . . . , V9), divides the nine reference gray scale voltage signals (V1, V2, . . . , V9) into 256 gray scale voltage signals, generates the analog gray scale voltage signals corresponding to the values of the image data D00~D05, D10~D15 and D20-D25 based on the 256 gray scale voltage signals, and outputs the analog gray scale voltage signals to the output buffer 540.

The output buffer 540 buffers the analog gray scale voltage signals to output the buffered analog gray scale voltage signals to the data lines of the liquid crystal display panel 100 line by line.

Although above exemplary embodiments discuss the driver circuit for driving the liquid crystal display device, the driver circuit for driving organic electroluminescence devices could be utilized.

While the exemplary embodiments of the present invention and their advantages have been described in detail, it should be understood that various changes, substitutions and alterations may be made herein without departing from the scope of the invention.

What is claimed is:

1. A device for driving a display apparatus, the device comprising:

a timing circuit including an oscillator which generates a first oscillating signal and an operation circuit which generates a control signal and including a counter that is configured to count a number of pulses of the first oscillating signal to generate a square wave signal;

a data driver that is configured to sample a first gray scale voltage signal in response to the control signal, and configured to generate a second gray scale voltage signal to provide to a display panel of the display apparatus, the second gray scale voltage signal having a voltage level substantially equal to a sampled voltage level of the first gray scale voltage signal, the sampled voltage level of the first gray scale voltage signal being synchronized with the control signal;

wherein the timing circuit further includes a booster that is configured to boost the first oscillating signal to generate a second oscillating signal, and the operation circuit generates the control signal based on the first and second oscillating signals; and the operation circuit further includes an AND gate that is configured to perform a logical AND operation on the second oscillating signal and the square wave signal to generate the control signal, and the square wave signal is activated in response to every given number of the pulses of the first oscillating signal.

2. The device of claim 1, wherein the control signal has an active level when both the second oscillating signal and the square signal have active status.

3. The device of claim 1, wherein the data driver includes:

a shift register that is configured to output a clock signal in response to an active period of the control signal;

a data latch that is configured to receive first image data and the clock signal, configured to latch a value of the first image data at an instance when the clock signal is input to the data latch, and configured to output the latched value of the first image data as second image data;

a digital-to-analog converter that is configured to receive a plurality of reference gray scale voltage signals to convert the second image data into a third gray scale voltage signal corresponding to the second image data using the reference gray scale voltage signals; and an output buffer that is configured to buffer the third gray scale voltage signal to output the second gray scale voltage signal.

4. A device for driving a display apparatus having a display panel, the display panel having a plurality of scan lines, a plurality of data lines and a plurality of pixels, the device comprising:

a scan driver that is configured to generate a plurality of scan signals activating the scan lines;

a timing circuit including an oscillator which generates a first oscillating signal and an operation circuit which generates a control signal and including a counter that is configured to count a number of pulses of the first oscillating signal to generate a square wave signal;

a data driver that is configured to sample a first gray scale voltage signal in response to the control signal, and configured to generate a second gray scale voltage signal to provide to a display panel of the display apparatus, the second gray scale voltage signal having a voltage level substantially equal to a sampled voltage level of the first gray scale voltage signal, the sampled voltage level of the first gray scale voltage signal being synchronized with the control signal;

wherein the timing circuit further includes a booster that is configured to boost the first oscillating signal to generate a second oscillating signal, and the operation circuit generates the control signal based on the first and second oscillating signals; and wherein the operation circuit further includes an AND gate that is configured to perform a logical AND operation on the second oscillating signal and the square wave signal to generate the control signal, and the square wave signal is activated in response to every given number of the pulses of the first oscillating signal.

5. The device of claim 1, wherein the control signal has an active level when both the second oscillating signal and the square signal have active status.

6. The device of claim 4, wherein the data driver includes:

a shift register that is configured to output a clock signal in response to an active period of the control signal;

a data latch that is configured to receive first image data and the clock signal, configured to latch a value of the first image data at an instance when the clock signal is input to the data latch, and configured to output the latched value of the first image data as second image data;

a digital-to-analog converter that is configured to receive a plurality of reference gray scale voltage signals to convert the second image data into a third gray scale voltage signal corresponding to the second image data using the reference gray scale voltage signals; and an output buffer that is configured to buffer the third gray scale voltage signal to output the second gray scale voltage signal to the data lines.

7. A display apparatus comprising:

a display panel having a plurality of scan lines, a plurality of data lines and a plurality of pixels;

a scan driver that is configured to generate a plurality of scan signals activating the scan lines;

a timing circuit including an oscillator which generates a first oscillating signal and an operation circuit which generates a control signal and including a counter that is configured to count a number of pulses of the first oscillating signal to generate a square wave signal;

a data driver that is configured to sample a first gray scale voltage signal in response to the control signal, and configured to generate a second gray scale voltage signal to provide to a display panel of the display apparatus, the second gray scale voltage signal having a voltage level substantially equal to a sampled voltage level of the first gray scale voltage signal, the sampled voltage level of the first gray scale voltage signal being synchronized with the control signal;

wherein the timing circuit further includes a booster that is configured to boost the first oscillating signal to generate a second oscillating signal, and the operation circuit generates the control signal based on the first and second oscillating signals; and wherein the operation circuit further includes an AND gate that is configured to perform a logical AND operation on the second oscillating signal and the square wave signal to generate the control signal, and the square wave signal is activated in response to every given number of the pulses of the first oscillating signal.

8. The display apparatus of claim 7, wherein the control signal has an active level when both the second oscillating signal and the square signal have active status.

9. The display apparatus of claim 7, wherein the control signal has a same period as a horizontal synchronization signal (HSYNC).

10. A method of driving a display apparatus, the method comprising:

generating a first oscillating signal;

counting a number of pulses of the first oscillating signal to generate a square wave signal;

generating a control signal;

generating a second gray scale voltage signal by sampling a first gray scale voltage signal in response to the control signal to provide to the display apparatus, the second gray scale voltage signal having a voltage level substantially equal to a sampled voltage level of the first gray scale voltage signal, the sampled voltage level of the first gray scale voltage signal being synchronized with the control signal;

wherein said generating the control signal further includes:

boosting the first oscillating signal to generate a second oscillating signal; and generating the control signal based on the first and second oscillating signals; and an AND gate that is configured to perform a logical AND operation on the second oscillating signal and the square wave signal to generate the control signal, and the square wave signal is activated in response to every given number of the pulses of the first oscillating signal.

11. The method of claim 10, wherein said generating a second gray scale voltage signal:

outputting a clock signal in response to an active period of the control signal;

latching first image data at an instance when the clock signal is applied to output second image data; and converting the second image data into a third gray scale voltage signal corresponding to the second image data using a plurality of reference gray scale voltage signals to provide a plurality of data lines of the display apparatus with the second gray scale voltage signal that is obtained by buffering the third gray scale voltage signal.

* * * * *